US007030306B1

(12) United States Patent
Chang

(10) Patent No.: US 7,030,306 B1
(45) Date of Patent: Apr. 18, 2006

(54) DEVICES FOR REMOVING AND SEPARATING MOISTURE FROM WOODWIND MUSICAL INSTRUMENTS

(76) Inventor: Shun-Hwa Chang, 40059 Catalina Pl., Fremont, CA (US) 94539

( * ) Notice: Subject to any disclaimer, the term of this patent is extended or adjusted under 35 U.S.C. 154(b) by 256 days.

(21) Appl. No.: 10/722,265

(22) Filed: Nov. 25, 2003

(51) Int. Cl.
*G10G 7/02* (2006.01)

(52) U.S. Cl. ..... 84/453; 84/380 R; 42/95

(58) Field of Classification Search ..... 84/453, 84/380 R, 384, 382, 387 R; 42/95
See application file for complete search history.

(56) References Cited

U.S. PATENT DOCUMENTS

| | | | | | |
|---|---|---|---|---|---|
| 1,730,785 | A | | 10/1929 | Ramao | 15/211 |
| 3,739,420 | A | | 6/1973 | Kafkis | 15/211 |
| 4,114,504 | A | * | 9/1978 | Koregelos | 84/453 |
| 4,967,439 | A | | 11/1990 | LaLonde | 15/104.095 |
| 5,171,925 | A | * | 12/1992 | Mekler | 42/95 |
| 5,212,332 | A | | 5/1993 | Gigliotti | 84/453 |
| 5,289,751 | A | | 3/1994 | Light | 84/275 |
| 5,555,588 | A | | 9/1996 | Viesehon | 15/104.16 |
| 5,829,088 | A | | 11/1998 | Ujihara et al. | 15/211 |
| 5,936,178 | A | | 8/1999 | Saari | 84/453 |
| 6,005,179 | A | | 12/1999 | Currie | 84/453 |

* cited by examiner

*Primary Examiner*—Shih-Yung Hsieh
(74) *Attorney, Agent, or Firm*—Roger H. Chu

(57) ABSTRACT

Devices for removing and separating moisture from interior passage of woodwind musical instruments are disclosed. According to one aspect of the present invention, 1) a de-moisturizing device includes a pocket sewed onto one side of the device to provide storage for the device hanging outside of an instrument carrying case, thus keeping the moisture absorbed by the swab re-moisturize the instrument; 2) a de-moisturizing device contains a closed loop affixed at one end of the device for holding a moisture absorbent fabric for removing moisture from the interior passage of woodwind instruments; and 3) a de-moisturizing device contains a plurality of moisture absorbent desiccant gels in an elongated hollow porous tube for removing moisture from the musical instruments.

4 Claims, 6 Drawing Sheets

DEVICES FOR REMOVING AND SEPARATING MOISTURE FROM WOODWIND MUSICAL INSTRUMENTS

BACKGROUND OF THE INVENTION

1. Field of the Invention

The present invention generally relates to devices for removing moisture from musical instruments, more particularly to devices for removing and separating moisture accumulated in the interior passage and valve pads of woodwind musical instruments such as flute, clarinet, saxophone, etc.

2. Description of the Related Art

While a player is breathing into a woodwind musical instrument, the column of air vibrates inside of the instrument, and the vibration is radiated from the instrument as sounds. However, the breath is warm and wet, containing water vapor which tends to condense onto the interior passage including the inner walls and valve pads of the woodwind instrument. The valve pads are made of soft material such as leather. When moisture is not promptly removed, the pads tend to harden and change their original shape. The leaking problems develop thereafter and the tone is distorted. Eventually the pads need be replaced to restore the instrument's function.

To prevent the problem caused by the moisture, proper removing the moisture accumulated in the interior passage of the instrument is required after playing. Many woodwind musical instruments are made up with a number of sections. Each section must be properly de-moisturized individually. Traditionally a pull through swab or fabric is used to wipe the moisture off the interior passage of each section of the instrument. There a number of different prior art swabs disclosed in U.S. Pat. Nos. 1,730,785, 6,005,179, 3,739,420, 5,212,332 and 5,829,088. However, using swab can only remove a portion of moisture condensed on the inner walls of the instrument. The same problem can still develop from the remaining moisture on the inner wall as well as the moisture in the valve pads. The damped swab is usually stored along with the instrument in an air-tight carrying case. This creates another source for the valve pads to develop problem, since the damped swab contains all the moisture just removed from the instrument may be able to transfer back inside the carrying case.

There exists another de-moisturizing device called demoisturizer as disclosed in the U.S. Pat. No. 4,114,504. The demoisturizer is used to absorb remaining moisture from the inner walls and from the valve pads. The common method for using the demoisturizer is to insert the device into the section of the instrument to be de-moisturized, and left both instrument and the demoisturizer in an air-tight carrying case. Again, the moisture may be able to transfer back to the instrument inside the carrying case. It is therefore a need for de-moisturizing devices to remove moisture more effectively and to separate the moisture from the instrument.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

The important object of the present invention is to ensure the moisture absorbed from the interior passage of woodwind musical instruments is physically separated from the instruments.

The present invention discloses devices for removing and separating moisture from interior passage of woodwind musical instruments. In one aspect of the present invention, a de-moisturizing device comprises a piece of moisture absorbent fabric, a hanging loop, a pocket, and a guiding means for pushing and pulling the fabric through the interior passage of the instrument. In one embodiment, the guiding means is a string fixedly attached to the fabric on one side. The pocket and hanging loop are sewed to the fabric on the other side. The pocket is used for storing the damped fabric and the string after wiping the moisture off the interior passage of a woodwind instrument. The hanging loop is used for hanging the pocket with stored fabric outside of a woodwind musical instrument carrying case. The device ensures that the removed moisture can not transfer back to the woodwind instruments because the device is stored in a pocket outside of the instrument's carrying case. The following procedure is used for a person to store the fabric and the string into the pocket: 1) hold the string up in one hand, let the rest of the device (i.e., the fabric and the pocket) dangle; 2) insert the fingers of the other hand into the pocket of the dangling device with palm facing up; 3) lower the string onto the fabric area opposite to the pocket and thus onto the holding palm of the other hand; 4) fold the excess fabric outside of the area of the palm into a smaller pile that can be grasp by the palm and 5) flip the pocket inside out to wrap up the string and the fabric into the final stored configuration. In another embodiment, the guiding means is a stick with a fabric holding means in one end. Exemplary holding means include a hole, a slot or a closed loop. The fabric is threaded through the holding means first. Then the stick may be used to guide the fabric moving forward and backward through the interior passage of the woodwind instrument.

In another aspect of the present invention, a de-moisturizing device includes moisture absorbing filaments disposed along an elongated member with an end cap handle in the one end and a closed loop attached to the other end for holding a piece of moisture absorbing fabric. As the device passes through the interior passage of the woodwind instrument, the majority of the moisture is wiped off by the fabric. Then the damped fabric is removed from the closed loop and is stored outside of a carrying case. This assures the majority of the moisture is separated from the instrument. Only the remaining moisture (e.g., the moisture accumulated in the valve pads) needs to be absorbed by the filaments as the device is kept inserted into the interior passage of the woodwind instrument.

In yet another aspect of the present invention, a de-moisturizing device includes an elongated hollow porous tube with a detachable end cap coupled on one end and another end cap attached on the other end. In order to remove the moisture, a plurality of moisture absorbing desiccant gels (e.g., DRICAP®) is inserted into the center of the hollow tube. The desiccant gels can be replaced when its moisture absorption capability has been reached, which is indicated by the color of the enclosed silica gels changing from blue to pink. The desiccant gel can also be reused with after drying in a microwave oven.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will be better understood with regard to the following description, appended claims, and accompanying drawings as follows:

DETAILED DESCRIPTION OF THE PREFERRED EMBODIMENTS

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art. In other instances, well-known components have not been described in detail to avoid unnecessarily obscuring aspects of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Embodiments of the present invention are discussed herein with reference to FIGS. 1A–4. However, those skilled in the art will readily appreciate that the detailed description given herein with respect to these figures is for explanatory purposes as the invention extends beyond these limited embodiments.

The present invention discloses devices for removing and separating moisture from the interior passage of woodwind musical instruments.

Figure 1A:
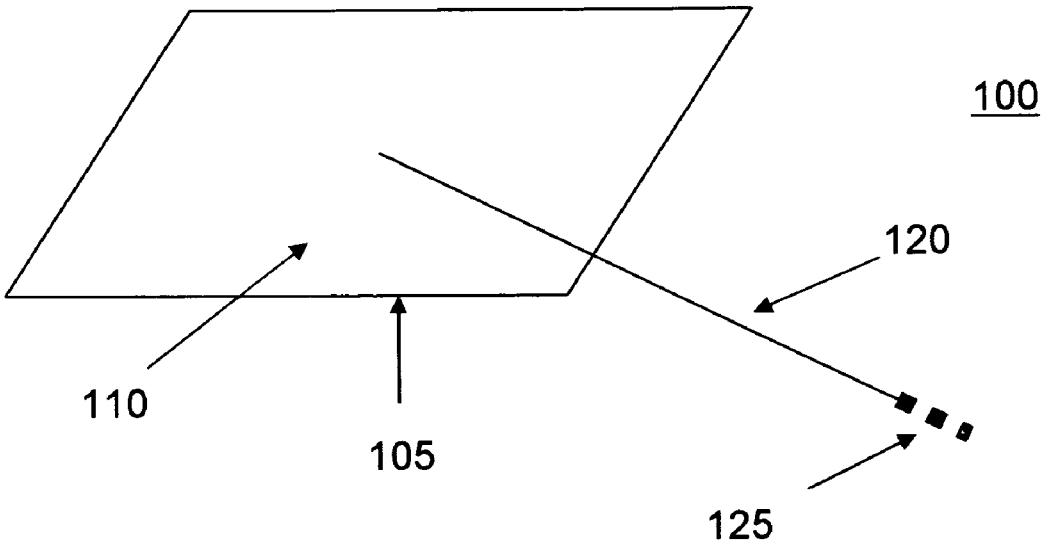
FIGS. 1A and 1B show an exemplary de-moisturizing device comprises a piece of fabric and a string in one side, and a pocket and a hanging loop in the other side.
Figure 1B:
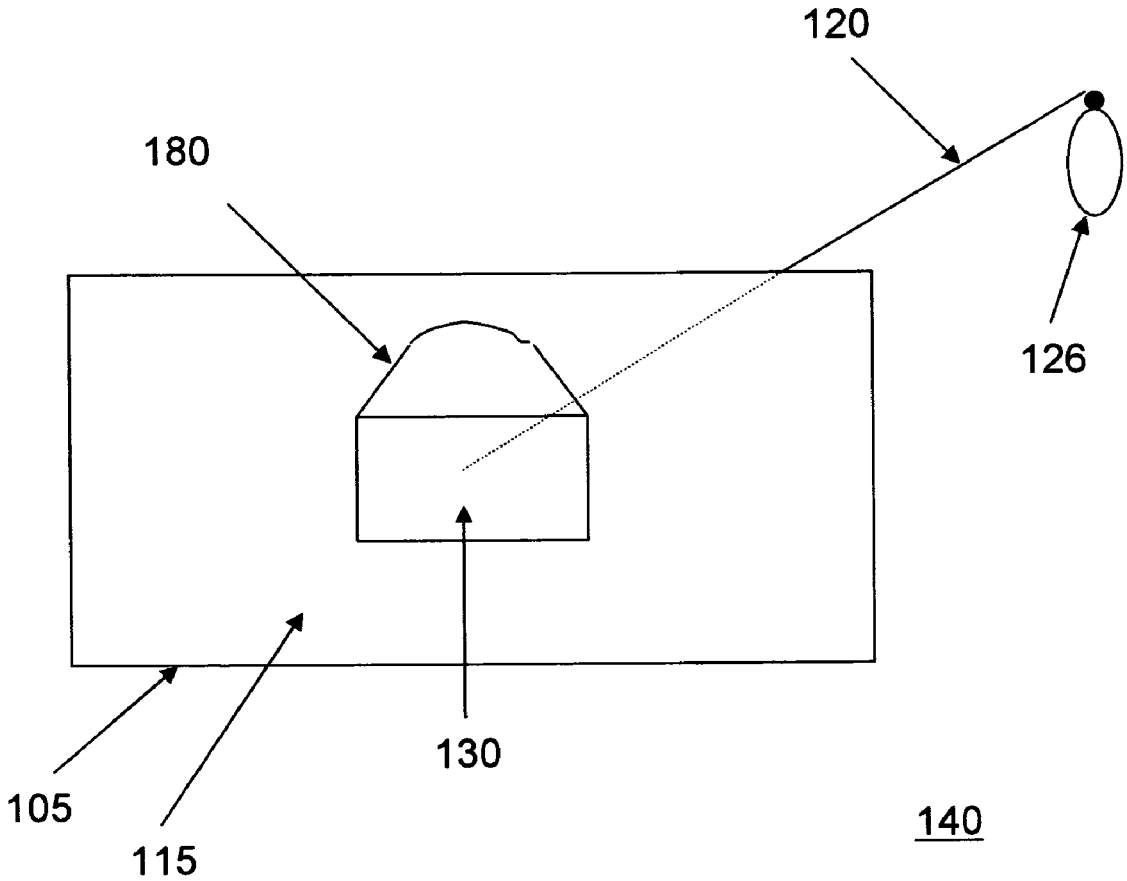

Referring now to the drawings, in which like numerals refer to like parts throughout several views. In one embodiment, FIGS. 1A and 1B show a de-moisturizing device of the present invention, which comprises a piece moisture absorbent fabric 105 (e.g., silk, cotton, or the like material), a guiding means for pushing and pulling the fabric through the interior passage of the woodwind instrument (e.g., a string 120), a pocket 130, a hanging loop 180 and an optional beads 125 attached to the free end of the string 120. FIG. 1A is a prospective view 100 of a de-moisturizing device from the first side 110 of the fabric 105. The string 120 is attached to the center of the fabric 105 in one end and free to the other end. Optional heavy object such as beads 125 may be attached to the free end of the string for easier operation of threading the string through the interior passage of a woodwind musical instrument. Beads 125 may be replaced by a weight 126. FIG. 1B depicts the view 140 from the second side 115 opposite to the first side 110 of the fabric 105. A pocket 130 and a hanging loop 180 are sewed to the second side 115 of the fabric 105. The pocket 130 and hanging loop 180 are used to store the fabric after the operation of wiping the moisture off the interior passage of woodwind musical instruments. The string 120 is of such length to permit passing through each section of the instrument to be de-moisturized. The fabric 105 is of such size and shape to allow enough contact with the interior passage of each section of the woodwind musical instrument to be de-moisturized. The shape of the fabric may be any shape (e.g., square, rectangle, circle, triangle, etc.).

Figure 1C:
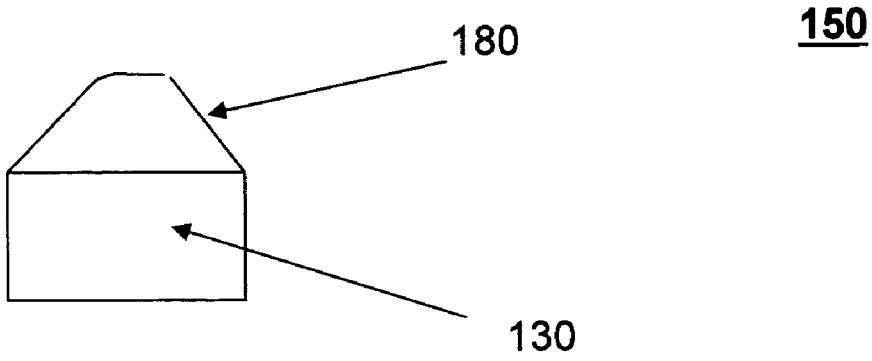
FIG. 1C depicts an exemplary de-moisturizing device is stored in its own pocket.
Figure 1D:
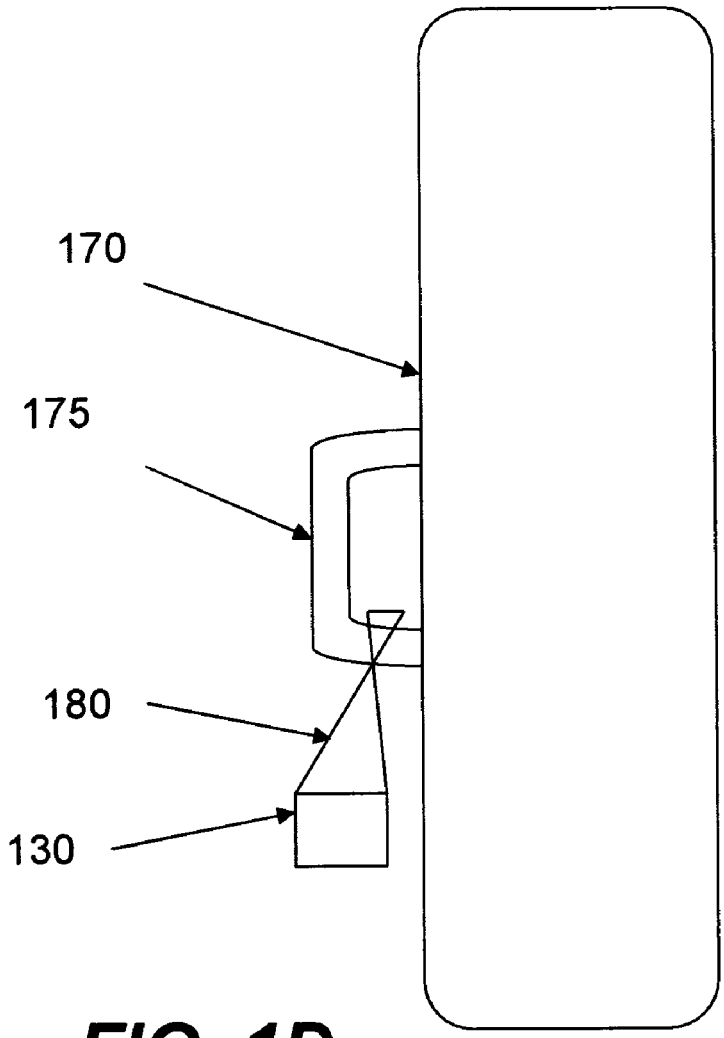
FIG. 1D shows an exemplary stored de-moisturizing device is hanged outside of the woodwind instrument carrying case.

FIG. 1C illustrates a stored configuration 150 of an exemplary de-moisturized device as shown in FIGS. 1A and 1B. The fabric 105, the string 120 and the weight 125 are stored in its pocket 130. The stored device may be hanged on the handle 175 of an instrument's carrying case 170 via the hanging loop 180 as shown in FIG. 1D, thus the removed moisture from the instrument is physically separated from the instrument.

Figure 2:
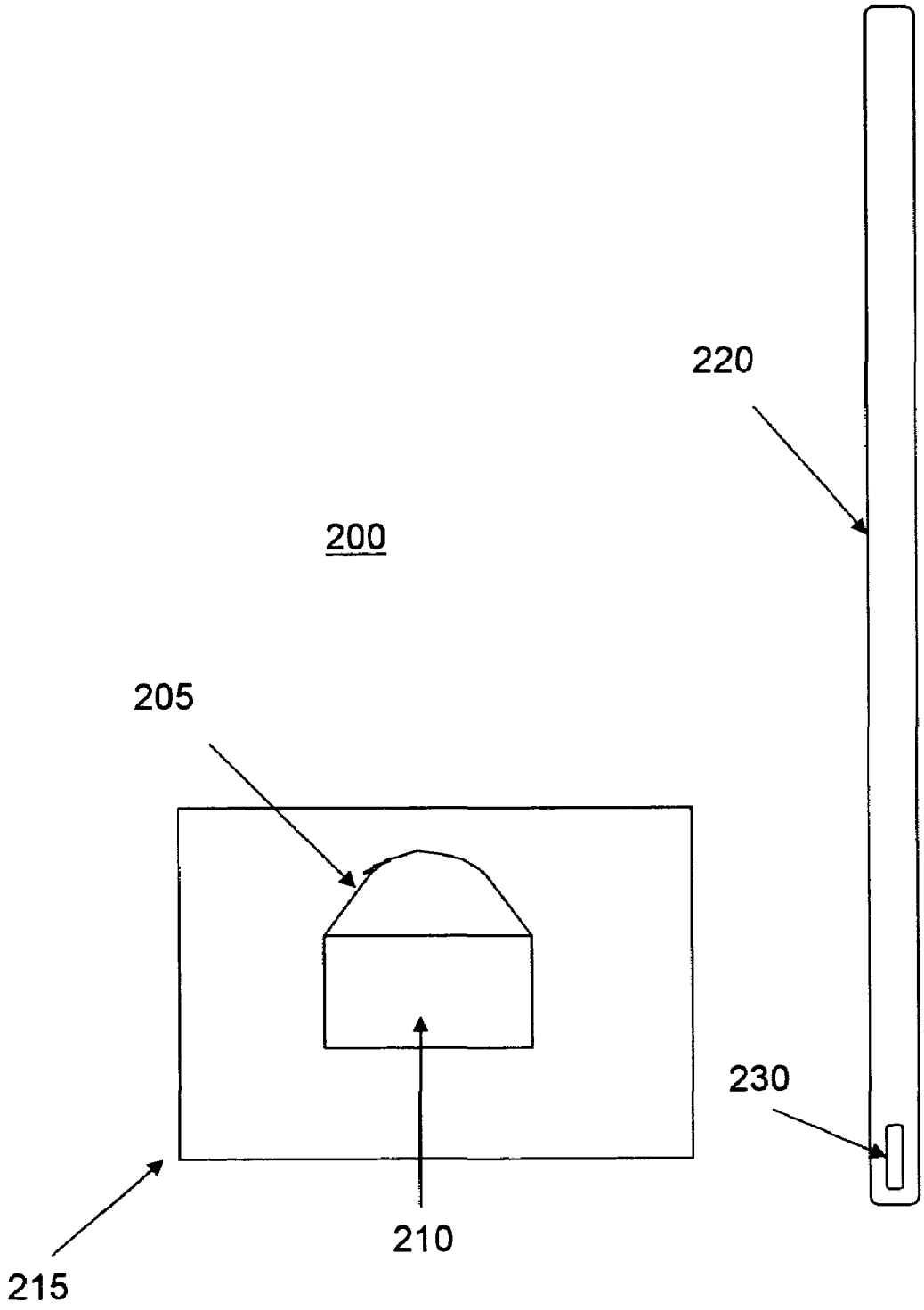
FIG. 2 illustrates another exemplary de-moisturizing device comprises a piece of fabric, a pocket and a hanging loop sewed on one side. A guiding stick having a fabric holding means in one end.

In another embodiment, the de-moisturizing device 200 is shown in FIG. 2. The device includes a piece of moisture absorbent fabric 215 with a pocket 210 and a hanging loop 205 sewed on one side, and a separate stick 220 as the guiding means. The stick 220 has a fabric holding means 230 (e.g., a hole, a slot, a closed loop) in one end. The fabric 215 is threaded through the holding means 230 first. Then the guiding means 220 may be used for guiding the fabric forward and backward through the interior of the instrument to remove the moisture.

Figure 3A:
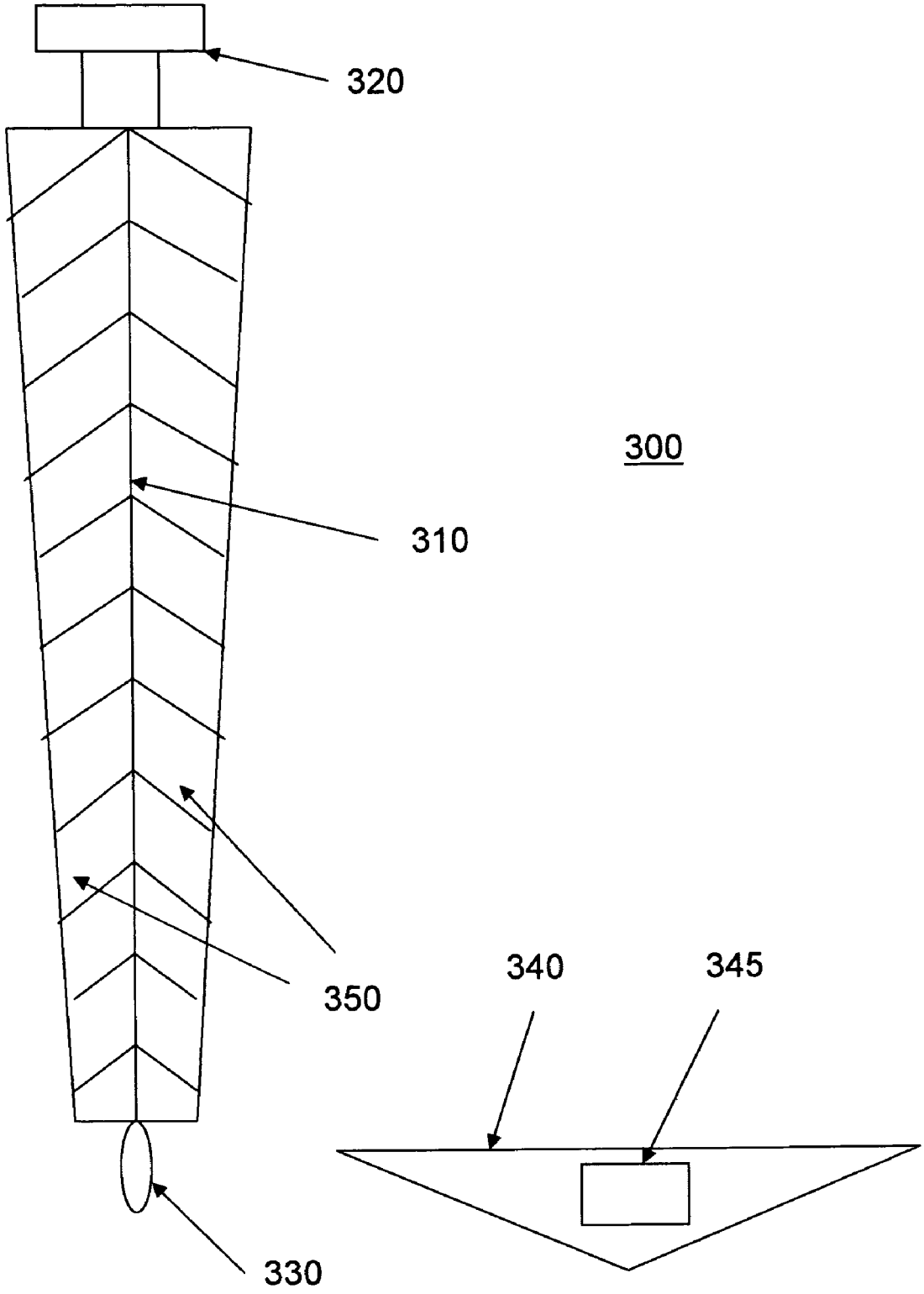
FIG. 3A illustrates an exemplary de-moisturizing device of the present invention. It includes a moisture absorbent fabric and a closed loop to hold fabric.
Figure 3B:
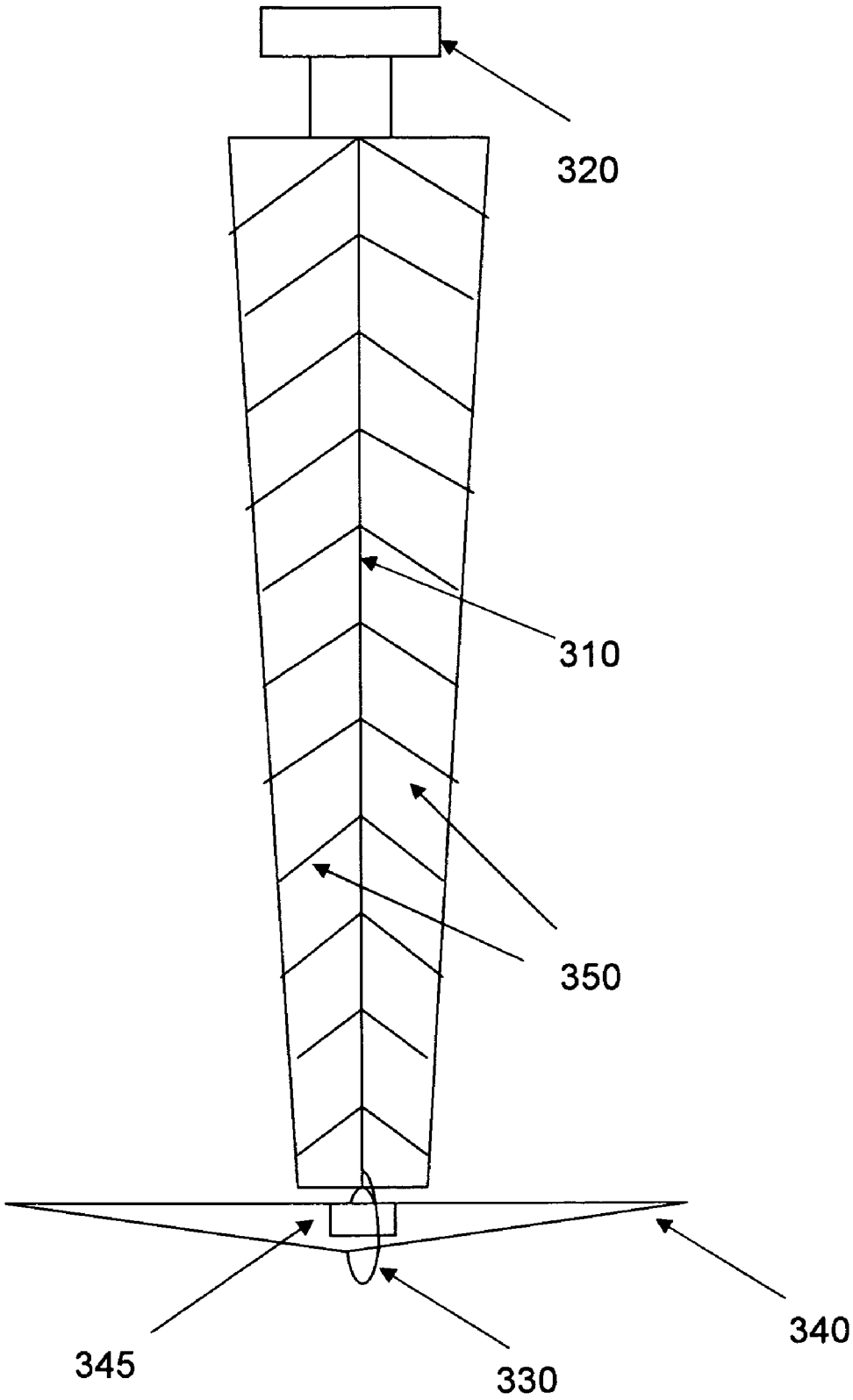
FIG. 3B shows the de-moisturizing device as shown in FIG. 3A with the fabric threaded through the closed loop in its operating configuration.

Referring now to FIGS. 3A and 3B, a de-moisturizing device 300 of the present invention is illustrated. FIG. 3A shows all the components of the de-moisturizing device 300, which includes an elongated member 310, with an optional end cap handle 320 affixed to one end and a closed loop 330 attached to the other end. A plurality of moisture absorbent filaments 350 is disposed along a substantial portion of the elongated member 310. A separate piece of moisture absorbent fabric 340 with a pocket 345 is also included. The elongated member 310 may be made of a twisted pair of wires. The fabric 340 may be made of silk with its size large enough to allow enough contact with inner walls of woodwind instruments to be de-moisturized. The length of the filaments is of such size to allow contact with the interior passage such as valve pads of the instrument. When this de-moisturizing device is used to remove the moisture from the interior passage of each section of a woodwind musical instrument, the fabric 340 is threaded through the loop 330 as shown in FIG. 3B. Then the whole device is inserted into the section that needs to be de-moisturized. As the device 300 passing through the interior passage, the majority of the moisture condensed on the inner walls is wiped off by the leading fabric 340. After the inserted device piercing the other end of the instrument, the damped fabric 340 can be taken off the closed loop 330 and stored outside the carrying case. The moisture on the fabric 340 will be separated from the stored instrument. The remaining moisture in the instrument, mainly the moisture in the valve pads, is absorber by the filaments 350 disposed along the elongated member 310 of the de-moisturizing device 300, which is left inserted inside the instrument. In order to accommodate various sections of the woodwind musical instruments, the elongated member 310 may have different length for different section of the instrument. Due to non-uniform cross-section of the musical instruments, the filaments 350 attached along the elongated member 310 may have different length to allow contact with the interior walls of the sections.

Figure 4:
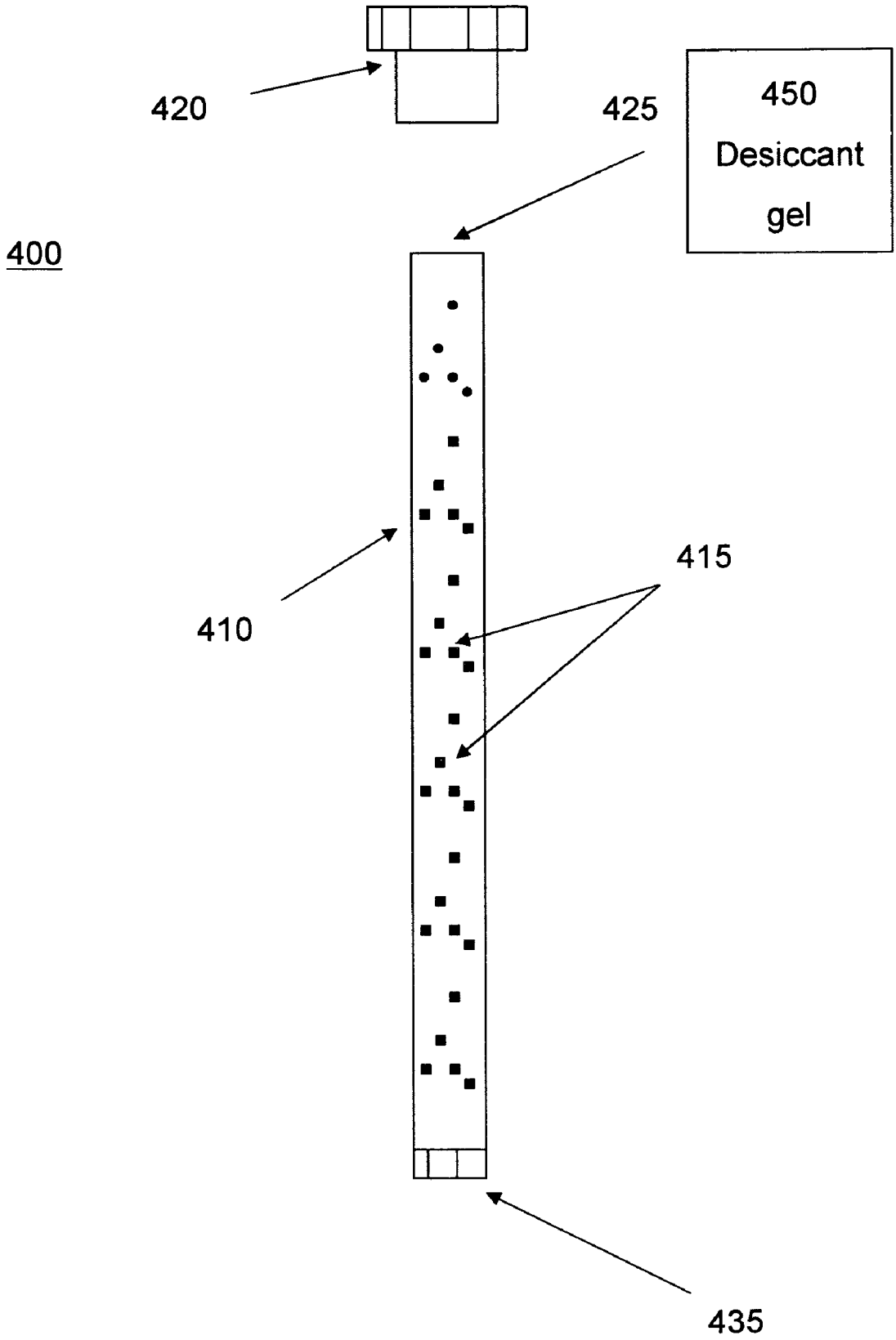
FIG. 4 is another de-moisturizing device disclosed in the present invention. It contains an elongated hollow porous tube with replaceable and reusable moisture absorbent desiccant gel inserted into the hollow center.

In another embodiment of the present invention, FIG. 4 shows a de-moisturizing device 400 that comprises an elongated hollow porous tube 410, with a detachable end cap 420 coupled on one end 440 and another end cap 435 fixedly attached to the other end. A plurality of replaceable and reusable moisture absorbent desiccant gels 450 is inserted into the hollow center of the hollow porous tube 410 through the opening 425. A plurality of holes 415 on the surface of the hollow porous tube 410 provides a path for moist air flow between the desiccant gel 450 and the interior passage of the woodwind instrument. These holes 415 are of such size that the desiccant gel 450 can not leak through them and are still large enough to let moist air through without problem. The de-moisturizing device 400 is left inserted into the interior passage of each section of the woodwind musical instrument after playing. The hollow porous tube 410 may be made of translucent plastic or the like material. In one embodiment, the moisture absorbent desiccant gels include the indicating silica gels. When the color of the silica gels changes from blue to pink, the desiccant gels have lost its moisture absorption capability. The old desiccant gels may be dehydrated in a microwave oven to be reused or replaced with new gels. One form of the exemplary desiccant gels is packed in a cartridge (e.g., DRICAP®).

Although an exemplary embodiment of invention has been disclosed, it will be apparent to those skilled in the art that various changes and modifications may be made to achieve the advantage of the invention. It will be obvious to those skilled in the art that some components may be substituted with another component providing same function. The appended claims cover the present invention.

I claim:

1. A de-moisturizing device for removing and separating moisture from interior passage of a woodwind musical instrument, the device comprising:

an elongated member;

a plurality of moisture absorbent filaments attached along a substantial portion of the elongated member, wherein the plurality of filaments has different length along the elongated member;

a closed loop fixedly attached to one end of the elongated member; and a separate piece of moisture absorbent fabric threaded through the closed loop for removing the moisture.

2. The device as recited in claim 1, further comprising:

an end cap handle fixedly attached to the other end of the elongated member.

3. The device as recited in claim 1, wherein the elongated member is of such length to cover a substantial portion of each section of the musical instrument.

4. The device as recited in claim 1, wherein the elongated member is made of a pair of twisted wires.

* * * * *